US006692688B2

(12) United States Patent
Contrucci et al.

(10) Patent No.: US 6,692,688 B2
(45) Date of Patent: Feb. 17, 2004

(54) MODULAR FURNACE

(75) Inventors: Marcos de Albuquerque Contrucci, Rio de Janeiro (BR); Pedro Henrique Carpinetti Costa, Santa Catarina (BR); Edmar Saul Marcheze, Santa Catarina (BR)

(73) Assignee: Startec Iron, LLC, Edina, MN (US)

( * ) Notice: Subject to any disclaimer, the term of this patent is extended or adjusted under 35 U.S.C. 154(b) by 0 days.

(21) Appl. No.: 09/811,427

(22) Filed: Mar. 20, 2001

(65) Prior Publication Data

US 2002/0135109 A1 Sep. 26, 2002

(51) Int. Cl.[7] ..... C21B 11/02
(52) U.S. Cl. ..... 266/144; 266/197
(58) Field of Search ..... 266/142, 143, 266/197, 172, 144

(56) References Cited

U.S. PATENT DOCUMENTS

| | | | | | |
|---|---|---|---|---|---|
| 2,942,866 | A | * | 6/1960 | Anderson | 266/197 |
| 3,864,122 | A | * | 2/1975 | Seelig et al. | 266/197 |
| 4,387,562 | A | * | 6/1983 | Takao et al. | 266/144 |
| 4,461,142 | A | * | 7/1984 | Nagata et al. | 60/39.02 |

* cited by examiner

*Primary Examiner*—Scott Kastler
(74) *Attorney, Agent, or Firm*—Ladas & Parry

(57) ABSTRACT

A modular apparatus for the production of molten metal by self reduction of agglomerates of metal oxide or of prereduced metal, which may be iron. The apparatus includes a plurality of connected cells of identical size and construction. Each apparatus is connected to equipment for supplying the agglomerates for reduction or melting and refining within a reduction chamber or melting chamber, respectively, of each cell.

4 Claims, 3 Drawing Sheets

FIG. 1
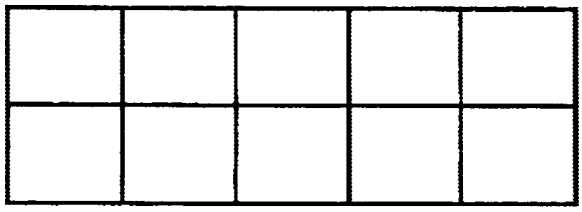
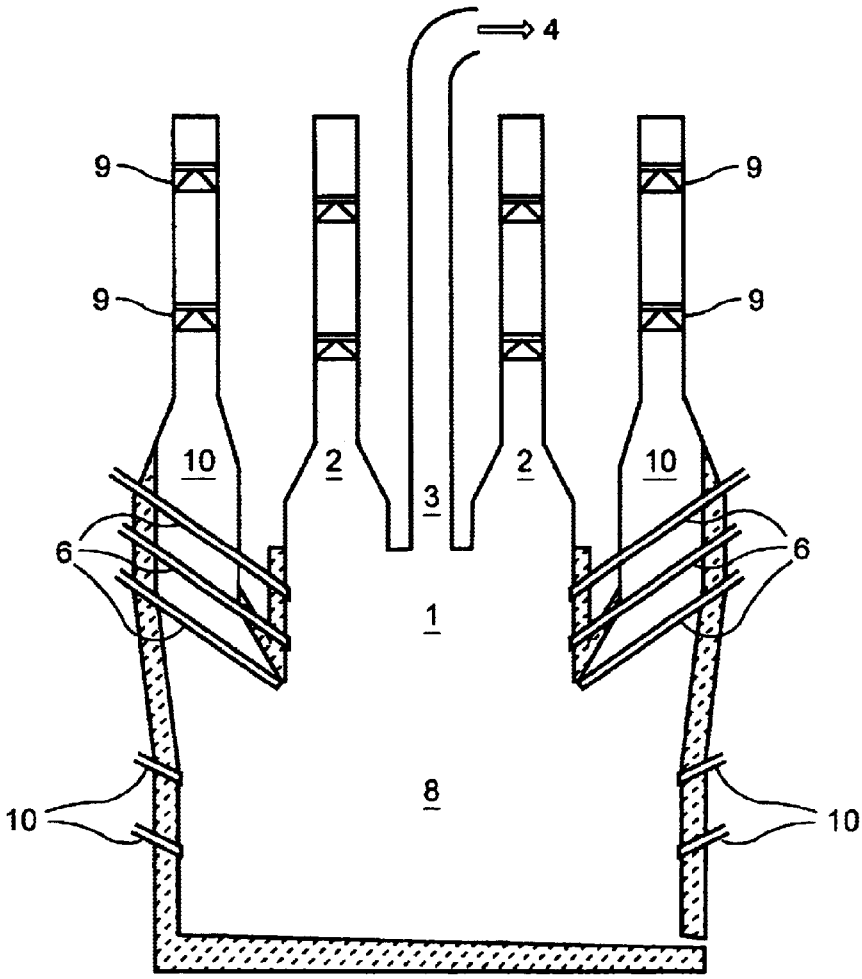
FIG. 2

MODULAR FURNACE

BACKGROUND OF THE INVENTION

The present invention relates to an apparatus for the production of molten metal by self reduction of agglomerates having oxides of the metal. This includes the production of molten iron, including pig iron and cast iron, as well as metal alloys.

Direct self reduction, and melting and refining processes are generously intended to either produce steel directly from iron ore, make a product equivalent to blast furnace pig iron for use in conventional steel making processes, or produce low-carbon iron as a melting stock for producing steel by conventional processes. These processes are generally intended to supplant blast furnaces as a source of molten iron for steel making.

Blast furnaces typically constitute a cylindrical tower wherein a charge comprising iron ore, pellets, or agglomerates, together with coke and limestone, are sequentially charged through the top of the furnace to form a continuous column of charge material. In the lower portion of the furnace, atmospheric air, which may be preheated, is introduced to the charge. When the charge materials come into contact with hot gases that are ascending from the hearth, the coke is preheated by these gases so that when it reaches the lower portion of the furnace and comes into contact with the air introduced thereto, it will be caused to burn. At the resulting high temperatures existing at this location of the furnace, carbon dioxide is not stable and reacts immediately with carbon to form carbon monoxide. This reaction is not only the main source of heat for the smelting operation, but it also produces a reducing gas (CO) that ascends through the furnace where it preheats and reduces the iron oxide in the charge as it descends through the furnace.

The production capacity of a blast furnace is a function of the internal volume or area and the furnace design parameters for a given production capacity. Consequently, to increase capacity requires increasing the size of the blast furnace and accordingly adjusting design parameters.

SUMMARY OF THE INVENTION

The present invention relates to a modular apparatus for producing molten metal, such as molten iron and molten metal alloys by self reduction of agglomerates of metal oxides or melting and refining of prereduced metal. There is provided a plurality of connected cells of identical size and construction that form this modular apparatus. Each cell is connected to a common means for supplying the agglomerates for self reduction or for melting and refining. Each reduction chamber or melting chamber is configured to produce molten metal of like composition by self reduction of the agglomerates under like reduction conditions or melting and refining of the agglomerates supplied to each of the reduction chambers or melting chambers, respectively. The agglomerates may contain either one or both of a reductant and a fluxing agent.

The like reduction or melting and refining conditions include temperature and feed rate of the agglomerates.

Each of the cells includes an identical preheating zone above the reduction chamber or melting and refining chamber through which the agglomerates are introduced and preheated prior to entering the chamber for the self reduction or melting and refining thereof.

Means are provided between the chamber and the preheating zone to direct and evenly distribute off gas from the self reduction or melting and refining through the agglomerates within the preheating zone. Means are additionally provided adjacent the preheating zone for burning combustible off gas from the self reduction or melting and refining to heat the agglomerates within the preheating zone.

The connected cells constitute a self reduction apparatus or melting and refining apparatus of modular or unit construction. Consequently, with the apparatus being divided into modules or unit fractions, each representing the entire equipment, allows the development and design of new furnaces on a one-to-one scale and further allows the performance of tests of different raw materials for changes in production capacity in a modular fashion.

BRIEF DESCRIPTION OF THE DRAWINGS

FIG. 1 depicts a schematic top view of the apparatus, evidencing the unit module construction thereof.

FIG. 2 is a cross-sectional view of the equipment that is the object of the present invention.

DETAILED DESCRIPTION OF THE PREFERRED EMBODIMENTS

Figure 3:
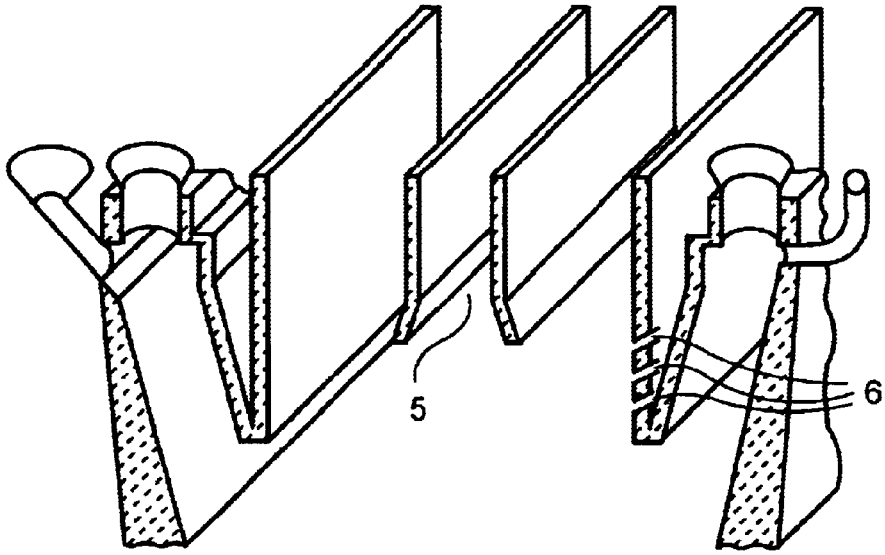
FIG. 3 depicts an elevated view of the equipment showing the hoods that direct and collect the gases at the top and effect the passage of the gases through the charge.

The apparatus of the present invention as shown in FIGS. 1 and 2 relates to a shaft furnace constructed from modular cells that can produce pig iron or cast iron or any other alloyed metal from self-reducing agglomerates or metallic charges. These identical cells are designed to be connected to form a furnace having an upper shaft 1, cylindrical or conical with rectangular cross-section, provided at the upper part thereof with gas charging devices or ports 2 and gas outlet devices or ports 3, for gases being conveyed to the gas scrubbing system 4 and subsequently to heat regenerators in order to preheat the blow air. Inside the upper shaft 1 there is provided a hood 5 extending longitudinally along the furnace (FIG. 3), made of a refractory material (cast iron or steel or any other alloy) or of cooled panels, depending on the distance between the hood and the top of the charge. Depending on the specific operation, the hood may be installed above the charge or partially covered by the charge. The hood is used to direct the gas flow in the upper shaft so that the same passes through the bed of charge to maximize the heat exchange between the gases and the charge, and to collect the gases from within the upper shaft and convey the same to the gas outlet 3. In the upper shaft 1 there are further provided one or more rows of tuyeres 6 that blow preheated or not preheated air, enriched or not with oxygen, for the secondary burning of the combustible gases that are present thereat. This provides additional heat for the processing of the charge.

Figure 4:
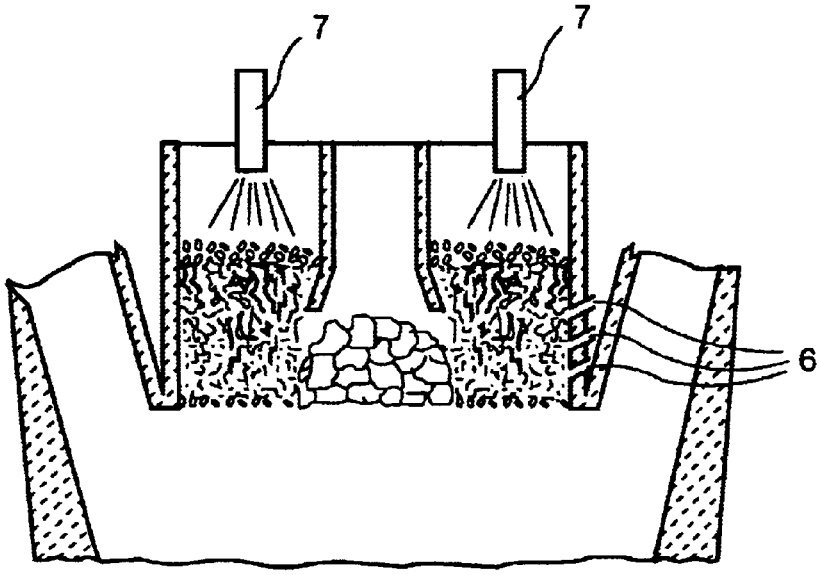
FIG. 4 is a cross-sectional view of the furnace of the present invention showing the burners positioned over the charge.

The equipment, according to the present invention, may further include one or more rows of burners 7 (FIG. 4) installed inside the upper shaft 1 between the side wall of the furnace and the outer wall of the hood at each side of the furnace and above the level of the charge to burn the gases coming from the furnace after the same has passed through the scrubbing system, as well as any other combustible gas or mixtures thereof. This provides additional heat to the charge to further increase the thermal efficiency of the furnace.

The furnace also includes a lower shaft 8, of cylindrical or conical shape, with a rectangular cross-section, having larger sides at the upper part thereof than the upper shaft 1, and sufficient for the positioning of feed devices to feed coke or coal or any other solid fuel to the charge. Around the lower shaft 8, at a level sufficiently higher than the base of the upper shaft 1, there is provided a continuous solid fuel feed section 11, as shown in FIG. 2. This section is fed through valves 9.

Figure 5:
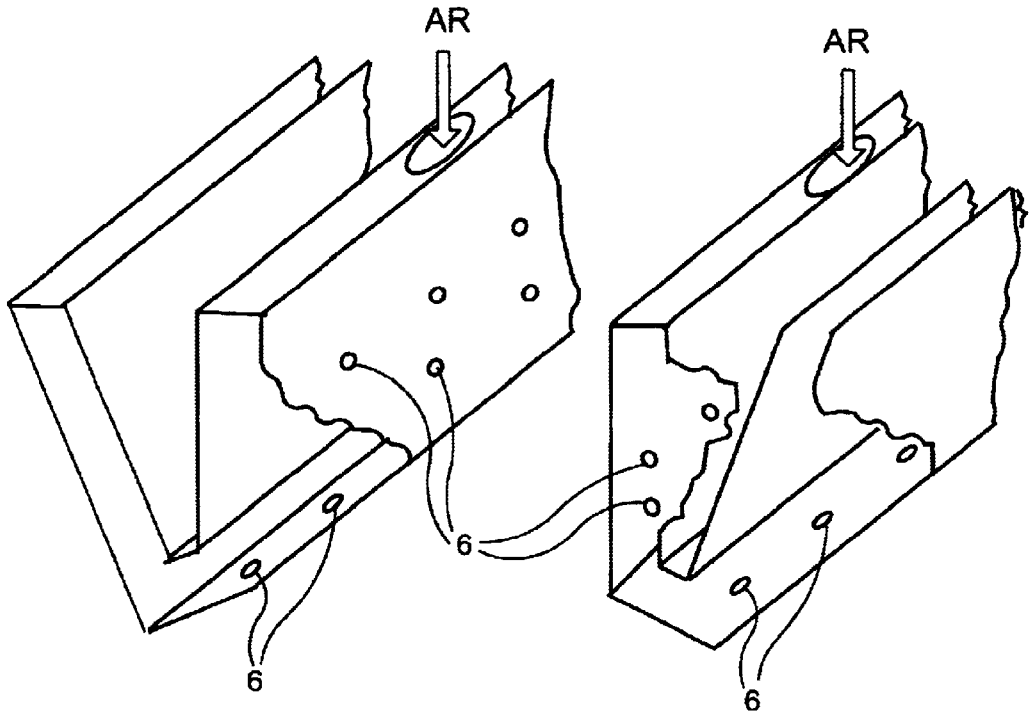
FIG. 5 is a cross-sectional view of the jointure between the upper and lower shafts provided with the secondary tuyeres.

The lower shaft 8 includes one or more rows of primary tuyeres 10 positioned to blow preheated or not preheated air, which may be enriched with oxygen. These tuyeres may inject liquid, gaseous or solid powdered fuels for partial or complete burning thereof to provide the thermal energy required to reduce and/or melt the charge. The upper shaft 1 and the lower shaft 8 may or may not include a monolithic refractory material and may or may not further include cooling means. Alternatively, the section joining the lower shaft 8 and the upper shaft 1 (FIG. 5) may be constructed in the form of one single metallic piece wherein are integrally provided the secondary tuyeres 6. The cooling of this section is provided by the air from the secondary blowing, which is heated and returned to the furnace. This conserves energy that would otherwise be lost if not used for this purpose.

The melted metal and the slag leave the furnace at the lower part thereof through appropriate outlets (not shown).

This apparatus can be constructed from unit cells having dimensions corresponding to a fraction of the total length of the furnace by one half of the total width of the furnace as shown in FIGS. 1 and 2. Each cell has the same number, the same size and the same diameter of primary tuyeres 10 and secondary tuyeres 6 per unit of length of the entire apparatus. Each separate cell therefore represents the furnace and may be used as a pilot furnace to determine, in true scale, its operating parameters, to avoid the need to apply non-dimensional factors, numerical simulations or any other conventional methods used to determine the final dimensions for the construction of equipment of this type. These conventional methods may not be entirely accurate due to their theoretical characteristics, resulting in a greater scalability risk, which does not occur when using the cell concept of this invention.

The modular cell construction of the invention apparatus also provides, for an existing apparatus of this type, the ability to increase the production capacity thereof by simply adding new cells to those already existing, in a proportion compatible with any desired capacity increase.

What is claimed is:

1. A modular shaft or blast furnace apparatus for the production of molten metal, which may be iron, by self reduction of agglomerates having oxides of said metal or by melting and refining of prereduced metal containing agglomerates comprising:

a plurality of connected cells of identical size and construction forming said modular apparatus;

each cell of said plurality of cells being connected to a common fuel source and to a common means for supplying self-reducing agglomerates having a common metal oxide for reduction within a chamber of each said cell or for supplying prereduced metal containing agglomerates for melting and refining within said chamber of each said cell; and each said chamber being configured to produce molten metal of like composition by self reduction or melting and refining, under like conditions, of said common oxide or said prereduced agglomerates, respectively, supplied to each said reduction chamber.

2. The apparatus of claim 1, wherein each said cell includes an identical preheating zone above said chamber through which said agglomerates are introduced and preheated prior to entering each said chamber for said self reduction or melting and refining thereof.

3. The apparatus of claim 2, wherein means are provided between each said chamber and said preheating zone to direct and evenly distribute off gas from said self reduction or melting and refining through said agglomerates within said preheating zone.

4. The apparatus of claim 3, wherein means are provided adjacent said preheating zone for burning combustible off gas from said self reduction or melting and refining to heat said agglomerates within said preheating zone.

* * * * *